US007946665B2

(12) United States Patent
Backhaus et al.

(10) Patent No.: US 7,946,665 B2
(45) Date of Patent: May 24, 2011

(54) SAFETY CABINET WITH MULTIPANEL FOLDING DOOR

(75) Inventors: Frank Backhaus, Herford (DE); Franz-Josef Hagen, Paderborn (DE)

(73) Assignee: Dueperthal Sicherheitstechnik GmbH, Kleinostheim (DE)

( * ) Notice: Subject to any disclaimer, the term of this patent is extended or adjusted under 35 U.S.C. 154(b) by 410 days.

(21) Appl. No.: 12/268,551

(22) Filed: Nov. 11, 2008

(65) Prior Publication Data

US 2010/0117501 A1 May 13, 2010

(51) Int. Cl.
*E06B 3/70* (2006.01)

(52) U.S. Cl. ..... 312/325; 312/324

(58) Field of Classification Search ..... 16/366, 16/370; 49/125, 127, 128, 345; 312/346–329, 312/271, 273, 274, 138.1, 139, 109
See application file for complete search history.

(56) References Cited

U.S. PATENT DOCUMENTS

| | | | | | |
|---|---|---|---|---|---|
| 138,879 | A * | 5/1873 | Gibbs | 49/345 |
| 3,181,596 | A * | 5/1965 | Russell et al. | 160/206 |
| 3,610,313 | A * | 10/1971 | Friedrich | 160/206 |
| 3,742,864 | A * | 7/1973 | Frech | 104/173.1 |
| 3,895,849 | A * | 7/1975 | Zehr | 312/324 |
| 4,034,437 | A * | 7/1977 | Robertson et al. | 16/48.5 |
| 4,161,804 | A * | 7/1979 | D'Hooge et al. | 16/48.5 |
| 4,262,448 | A * | 4/1981 | Flider | 49/367 |
| 5,186,230 | A * | 2/1993 | Ostrander | 160/206 |
| 5,551,187 | A * | 9/1996 | Brouwer et al. | 49/1 |
| 5,582,472 | A * | 12/1996 | Lyons et al. | 312/324 |
| 5,722,202 | A * | 3/1998 | Cooper | 49/109 |
| 5,813,739 | A * | 9/1998 | White | 312/409 |
| 5,816,309 | A * | 10/1998 | Paradise | 160/206 |
| 5,944,399 | A * | 8/1999 | Gillispie | 312/324 |
| 7,814,897 | B2 * | 10/2010 | Larsen | 126/191 |
| 2004/0140062 | A1 * | 7/2004 | Lee | 160/117 |
| 2009/0134756 | A1 * | 5/2009 | Kampf et al. | 312/326 |

FOREIGN PATENT DOCUMENTS

| | | |
|---|---|---|
| DE | 20019307 | 2/2001 |
| DE | 202004004855 | 9/2004 |

* cited by examiner

*Primary Examiner* — Janet M Wilkens
(74) *Attorney, Agent, or Firm* — Andrew Wilford

(57) ABSTRACT

A cabinet has a body having an open side and two doors each comprised by an outer panel and an inner panel. The panels are pivotal between a closed position in which they are all generally coplanar and cover the open side with the inner panels between the outer panels and an open position giving access to the open side. A respective actuating mechanism for each door has an actuating element defining first, second, and third pivot points and pivoted on the body at the respective first pivot point and a pusher pivoted on the respective second pivot point and having a pair of arms with outer ends connected to the respective doors. A rigid connector extends between the third pivot points at all times across a line extending between the first pivot points.

14 Claims, 2 Drawing Sheets

SAFETY CABINET WITH MULTIPANEL FOLDING DOOR

FIELD OF THE INVENTION

The present invention relates to a cabinet with a multipanel door. More particularly this invention concerns a safety cabinet whose door folds when opened.

BACKGROUND OF THE INVENTION

It is known to provide a safety cabinet of the type used to store dangerous chemicals or tools with a folding door having a plurality of panels that are coplanar and cover an open side of the cabinet when closed and that fold up to give access to the open side when open. In a typical such door there are four panels including two outer panels and two inner panels between the outer panels. Each outer panel is coupled via a link mechanism to the respective inner panel, and the two link mechanisms are in turn connected together for joint and synchronous movement between the inner and outer positions.

German patent document 20 2004 004 855 describes such a cabinet. Here each door is equipped with a synchronizing lever and also with a link lever. The synchronizing levers are hinged to one another via a connecting element that moves in a guide. The guide runs perpendicular to a plane the doors lie in when closed and that is perpendicular to a center plane of the cabinet symmetrically flanked by the vertical pivot axes of the door panels.

In addition there is a spring that biases the doors shut and that extends along the guide or is accommodated therein. True synchronous movement of the doors is supposed to be enabled in this manner without one of the doors having to follow the other or vice versa. In addition, it serves to hold the doors in the open position.

This system has proven itself in terms of one-handed operation of the two folding doors due to the connecting element. However, the mechanical complexity is relatively high and the actuating spring is actuated every time the door is opened or closed. This spring is a scroll spring that is anchored at one end in the cabinet. The anchor is connected to the cabinet via a temperature-dependent fusible connecting element so the door closes automatically if there is a fire. As a result it is not always possible to preclude functional limitations because the known scroll spring is operated during each closing process and it is therefore subject to metal fatigue. This is particularly true of the temperature-dependent fusible connecting element so that in general functional reliability cannot always be assured, especially if there is a fire.

The same is also true for the system in accordance with German patent document 200 19 307. In the case of this safety cabinet, the automatically closing folding door has two hinged folding panels. One folding panel is connected to a lever that can be directly or indirectly rotated by a door closer. One end of the lever is connected to an axis shaft that is pivoted on the door closer or a wall of the safety cabinet. The other end of the lever is connected to the second folding door that is hinged, directly or indirectly, to the first folding door, which is itself pivoted on the cabinet.

OBJECTS OF THE INVENTION

It is therefore an object of the present invention to provide an improved safety cabinet with a multipanel folding door.

Another object is the provision of such an improved safety cabinet with a multipanel folding door that overcomes the above-given disadvantages, in particular that is simpler and more reliable.

SUMMARY OF THE INVENTION

A cabinet has a body having an open side and two doors each comprised by an outer panel and an inner panel. The panels are pivotal between a closed position in which they are all generally coplanar and cover the open side with the inner panels between the outer panels and an open position giving access to the open side. A respective actuating mechanism for each door has an actuating element defining first, second, and third pivot points and pivoted on the body at the respective first pivot point and a pusher pivoted on the respective second pivot point and having a pair of arms with outer ends connected to the respective doors. A rigid connector extends between the third pivot points at all times across a line extending between the first pivot points.

In other words, the two actuating mechanisms that are coupled to one another via the connecting element are in a parallelogram-like position with the doors closed and in a triangular position with the doors open. To this end the actuating mechanism each have an actuating element that can pivot about a pivot point and a pusher attached thereto on the door side, the pusher acting on the outer panel and the inner panel of the associated folding door via one outer panel bar or arm and one inner panel bar or arm.

Thus, in contrast to the prior art in accordance with above cited DE 20 2004 004 885, an identical synchronous movement of the actuating mechanisms does not occur directly when opening and closing the door, but rather the actuating mechanism changes its topological configuration. Thus when the doors are closed the actuating mechanism assumes a parallelogram-like position. In contrast, door opening corresponds to a triangular position for the associated actuating mechanism.

In this context it is understood that the transition from the parallelogram-like position to the triangular position and back for both actuating mechanisms naturally occurs simultaneously or nearly simultaneously, that is synchronously, because both actuating mechanisms are coupled to one another via the connecting element. In contrast to the prior art, as described, the actuating mechanism only changes its topological configuration.

Overall, favorable lever relationships are provided. Because during door closing and door opening, or in order to move the closed folding doors to the open position, initially work is performed with relatively large lever arms due to the parallelogram-like position of the actuating mechanism, so that great torque can be transferred to the associated panel doors. As the doors open further, the lever arms become smaller, and consequently the torque decreases. At the same time, the finally attained door opening corresponds to a particularly compact shape for the actuating mechanism, specifically its triangular position, so that the cabinet body can be accessed with practically no obstacles in order to store for instance chemicals or other safety-relevant substances therein.

Filling the cabinet with stored liquid and solid substances, and removing them therefrom, is not impeded by any mechanical elements. In addition, the inventive cabinet, especially safety cabinet, can be opened and closed with one hand so that the other hand can be used for filling the cabinet or removing items therefrom. This constitutes the essential advantages.

It has proved advantageous when the actuating element is embodied as a triangle element. Consequently the actuating element or triangle element overall provides triangle areas. The connecting device is attached to one corner pivot of the actuating element. Another corner pivot is for the connection to the pusher. The final, remaining corner pivot advantageously has the pivot point.

When closing and opening the doors, the pusher, like the actuating element, pivots and in addition undergoes a parallel displacement out of the cabinet body. The pivotal movement is determined on the one hand by the actuating element and on the other hand by a fixed body-side pivot point. The body-side pivot point corresponds to the respective folding door and is mounted inside the associated cabinet body.

In addition, the folding door is provided with an arm that engages at the fixed body-side pivot point. Generally the arm and the pivot point in question are mounted near the bottom or top wall of the cabinet body so that it does not have a negative impact on the useful volume within the cabinet body. Naturally it is also conceivable and within the framework of the invention to have one arm near the floor and also one near the head, with the associated pivot point. In contrast, the actuating mechanism, and, with it, the connecting element are primarily received in the upper region of the cabinet body. To this end the upper region may be equipped with corresponding bearing blocks or mounting frames.

Normally one mounting frame is provided for each folding door and arranged in the upper region of the cabinet body. The mounting frame, actuating mechanism, and connecting element that couples the two actuating mechanisms may be arranged overall in a separate upper region of the cabinet body, but this is not required.

The panel bars, i.e. the outer panel bar and the inner panel bar for the associated folding door, are each advantageously attached at their ends to the pusher. When closing and opening the doors, the panel bars transition from a nearly parallel position to an angular position relative to one another. Another door closer that is attached directly or indirectly to the connecting element has particular significance. The door closer may ensure that each folding door is opened or closed and this process (which as a rule is initiated manually) is mechanically assisted. In addition, as a rule the door closer ensures that the closing movement of the folding doors is damped.

In the framework of the invention it is now significant that at least one element of the door closer is held in the pre-stressed position by means of a release device. In addition, the design can be such that the door closer ensures automatic door closing only after the release device has been actuated and otherwise is not employed. The element in question may be an arm that is attached to the door closer and that itself acts directly on the connecting element or is attached to one of the two actuating mechanisms.

If the release device is actuated when the folding doors are opened the pre-stressed element or the above-described closing arm ensures that the door closer engages the connecting element or a actuating mechanism and urges it to close the doors. Because the two actuating mechanisms are coupled to one another by the connecting element, this ensures automatic and uniform closing of both folding doors.

The release device can hold the element in a pre-stressed position for instance using an electromagnet that can be released individually or controlled centrally. However, primarily a temperature-dependent fusible solder is used that, when a certain critical temperature is exceeded, ensures that the element in question leaves its pre-stressed position and the strain energy stored in the element or the energy obtained in the door closer is used to effect automatic door closing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
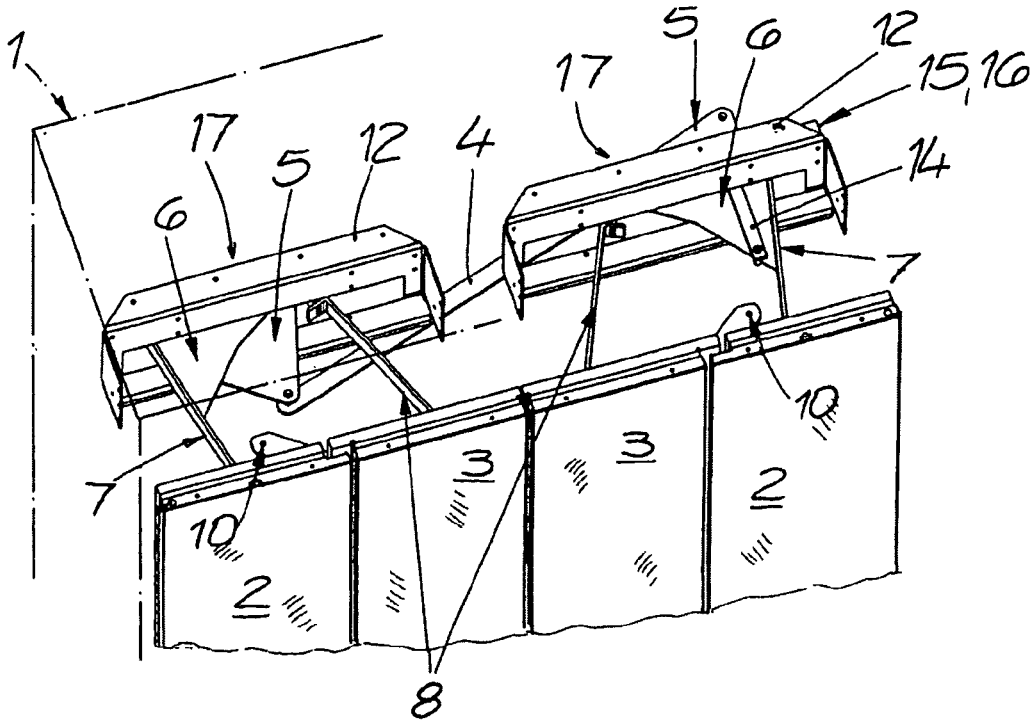
FIG. 1 is a partly schematic perspective view from above of a portion of a safety cabinet with a multipanel folding door in the closed position.

As seen in the drawing a cabinet 1 (illustrated in dot-dash lines for clarity of view) may be a safety cabinet, but is not thereby restricted. This cabinet 1 may accommodate hazardous substances, liquid chemicals, or solid chemicals, or may be designed as a laboratory tool/equipment cabinet. In any case, as a rule potentially dangerous things and substances are stored in the cabinet in question, which substances are frequently explosive, so that in certain cases is necessary that the cabinet close automatically. Convenient operation using only one hand is also desirable.

To this end the described cabinet 1 in this case is a safety cabinet with folding doors and has a parallepipedal rigid body with rigid and normally insulated top, bottom, side, and back walls defining an open front side closable by two outer door panels 2 and two inner door panels 3. A connecting element 4 couples the two sets of folding doors 2 and 3. The outer doors 2 are pivoted immediately adjacent the outer front corner of the cabinet 1 at a fixed vertical axis 18, and the inner doors 3 are pivoted at vertical axes 10 on the roof and floor of the cabinet at locations somewhat deeper into the structure. To this end the inner doors 3 are provided with angled arms 11 that extend to the respective offset axes 10. These axes 10 and 18 are stationary.

The connecting element 4 acts on each attached folding door 2 and 3 by a respective actuating mechanism 17. The actuating mechanisms 17 are each constructed of at least two parts, an actuating element 5 and a pusher 6 attached thereto. Each pusher 6 is L-shaped and attached to the respective actuating element 5 on the door side, i.e. toward the folding doors 2 and 3.

More particularly, each pusher 6 is itself connected to the respective folding doors 2 and 3 via bars 7 and 8. The bar 7 is unitary with and part of the pusher 6 and the bar 8 has an inner end pivoted on the pusher. The outer ends of the bars 7 and 8 are pivoted on the respective door panels 2 and 3 about vertical axes offset from the respective pivots 18 and 10.

Each actuating element 5 is triangular with three corner pivots 5*a*, 5*b*, and 5*c*. The connecting element 4 is attached to the corner pivot 5*a*. The corner pivot 5*b* is connected to the pusher 6 and to the inner end of the respective inner panel bar 8. The remaining corner pivot 5*c* of the actuating element or triangle element 5 is pivoted at a fixed vertical axis 9 on the cabinet 1 so that the element 5 pivots about this fixed pivot point or axis 9 when the door is being opened or closed, specifically counterclockwise about an angle $\alpha$ of approx. 60°, although a greater or larger angle is within the scope of this invention. Proceeding from FIGS. 2*a*, 2*b* with the folding doors 2 and 3 in the open position, in order to move to the closed position of FIGS. 1*a* and 1*b*, the actuating element or triangle element 5 must consequently be pivoted clockwise about the same pivot point 9, again by the angle α.

When opening, the pusher 6 also pivots. The extent of pivoting by the pusher 6 is determined on the one hand by the spacing between its corner pivot 5*b* and the fixed pivots 10 on the cabinet 1. At the same time the pusher 6 pivots clockwise pivot movement about an angle β of approx. 15°. Of particular significance is that the pusher 6 simultaneously shifts transversely relative to the frames 12 carrying the devices 17, and in fact moves to a position projecting partially out of the cabinet body 1. In fact the primary function of the frames 12 is to carry the actuating mechanisms 17, in particular carrying the pivot point 9 and also a stop 14 that limits pivoting of the right-hand actuating mechanism 17 and consequently of both sets of folding doors 2 and 3.

Figure 2:
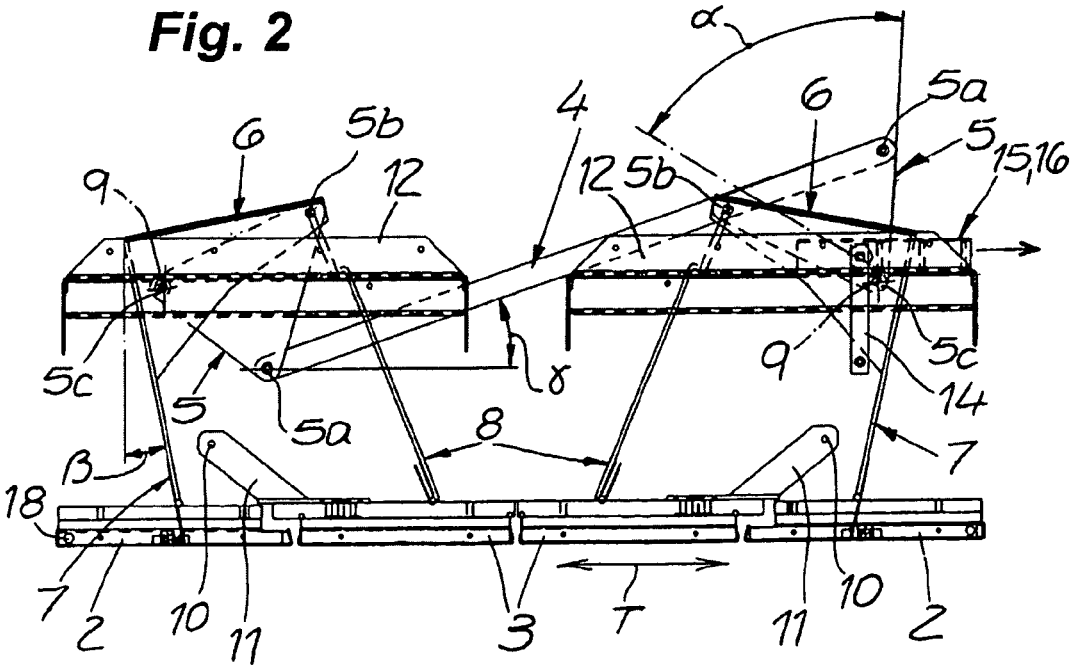
FIG. 2 is a top view of the mechanism of the door as shown in FIG. 1.
Figure 3:
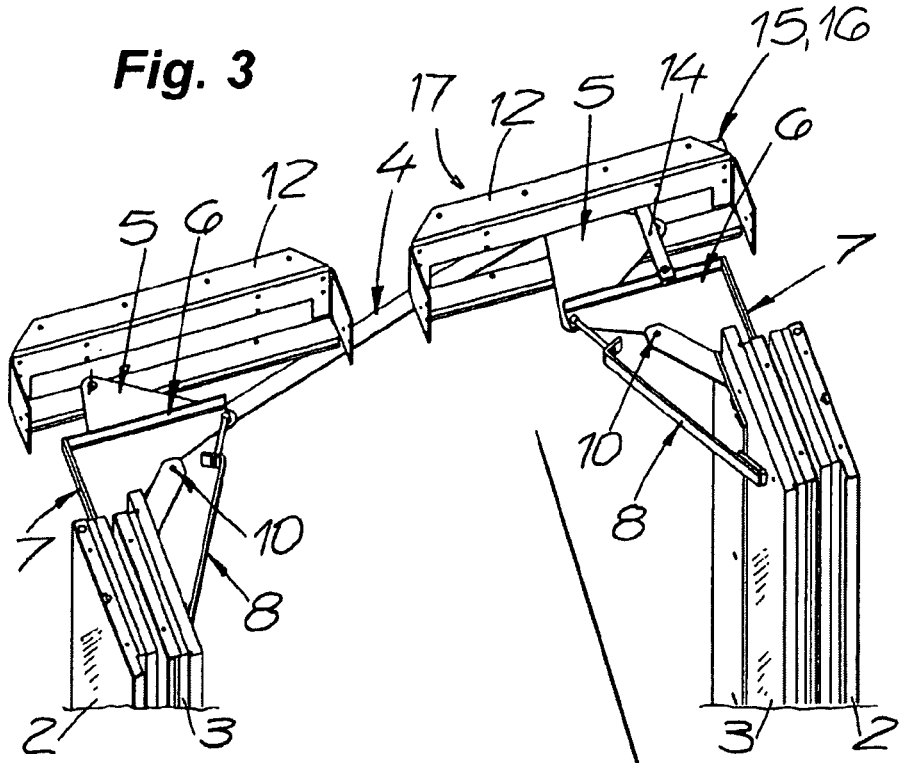
FIG. 3 is a view like FIG. 1 but in the open position.
Figure 4:
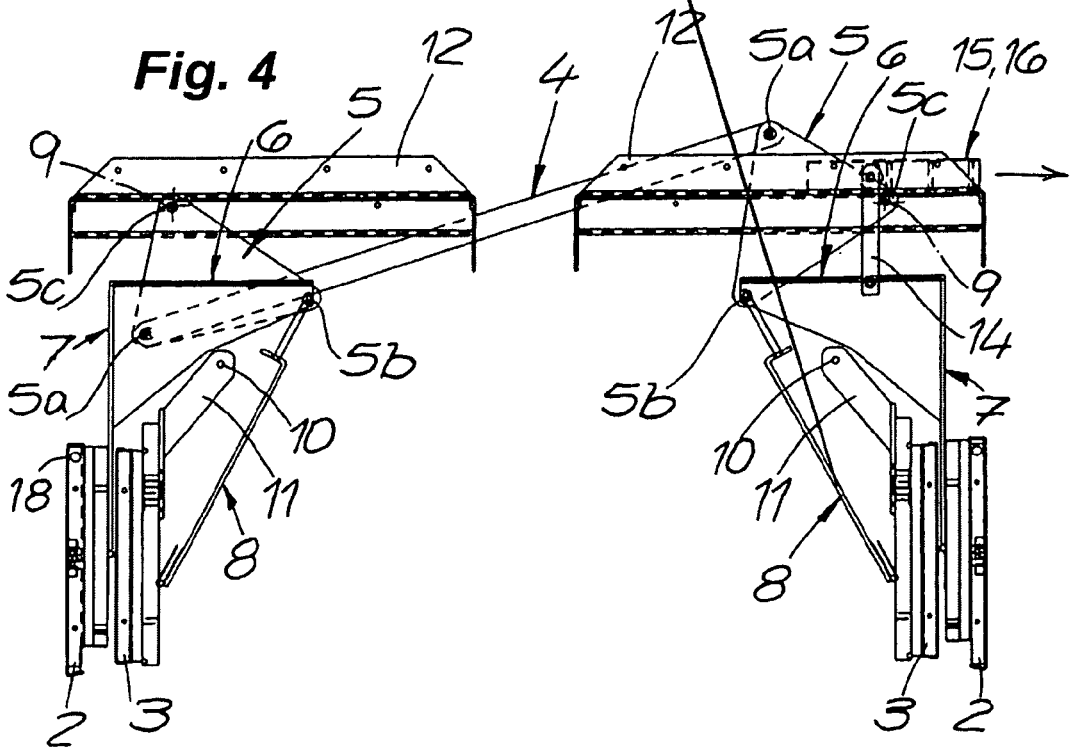
FIG. 4 is a top view of the mechanism of the door as shown in FIG. 3.

It can be seen in particular from the schematic cross-sections of FIGS. 1*b* and 2*b* that the connecting element 4 essentially moves in a straight line parallel to its own longitudinal axis when opening and closing, with a slight shift transverse to itself. Overall the connecting element 4 is extends at a small acute angle γ to a door closing plane T spanned by the folding doors 2 and 3. In this case the angle γ in question for the incline position is approx. 20° to 30°.

When opening, the two actuating mechanisms 17 start in their parallelogram-like position in accordance with FIGS. 1*a*, 1*b* and when closing start in their triangular position in accordance with FIGS. 2*a*, 2*b*. Specifically the respective panel bars 7 and 8 attached at their ends to the associated pusher 6 have nearly parallel positions in the closed-door position. However, if the pusher 6 is pivoted slightly about the angle β for door opening and is simultaneously pushed in the direction of the folding doors 2 and 3 opposite the associated mounting frame 12, the panel bars 7 and 8 in question leave their nearly parallel position corresponding to FIGS. 1*a*, 1*b* and move into an angled position corresponding to FIGS. 2*a*, 2*b*.

As a consequence of this the two panels 2 and 3 of the panel doors 2 and 3 are positioned cascade-like parallel and adjacent to one another in their open position. This provides a maximum access area, provided by the folding doors 2 and 3, to the interior of the cabinet body 1, which facilitates the removal and addition of for instance safety-relevant substances.

In the illustrated embodiment, an additional door closer 15, 16 is associated with the right-hand folding door 2 and 3. This door closer 15, 16 is directly or indirectly attached to the connecting element 4. The door closer 15, 16 in question can also act on one of the two actuating mechanisms 17, for instance the actuating element 5. In the present case the door closer 15, 16 is embodied in two parts and has a pre-stressed spring 15 and a release device 16. The spring 15 is held in its pre-stressed position by means of the release device 16. After the release device 16 has been actuated, the spring 15 ensures that the two (open) folding doors 2 and 3 are automatically closed.

The spring 15 may be a scroll spring that is held in a longitudinally extended stressed or loaded position by the release device 16. If the release device 16 is actuated, the spring 15 relaxes or rolls up and ensures that the associated actuating mechanism 17, and with it the attached folding doors 2 and 3, automatically assume the closed position.

Because the actuating mechanism 17 is connected via the connecting element or the connecting arm 4 created at this location to the other actuating mechanism 17 for the other folding door 2 and 3, this folding door 2 and 3 is also closed automatically and in the same phase. This action results because the two devices 17 are mirror-symmetrical to each other and the connecting element or link 4 always extends at a small acute angle across a line joining the two pivots 9, thereby ensuring identical but opposite rotation of the two actuating elements 5.

The release device 16 in this case is a fixed element having two metal plates that hold the spring 15 or the scroll spring in its pre-stressed position using fusible solder that melts at an elevated temperature. If the temperature in question of for instance approx. 50° C. is exceeded, the fusible solder converts liquefies and the spring or the spring 15 is released and assumes its relaxed position. The actuating mechanism 17 is carried along if the associated folding door 2 and 3 is in the open position. This applies for both folding doors 2 and 3 due to the coupling of the two folding doors 2 and 3. If the doors are closed, such release ensures that they are held closed by the spring 15.

It is understood and is clear that the door closer 15, 16 is only active in exceptional circumstances, specifically when the critical temperature of 50° C. is exceeded and the release device 16 has been actuated to release the element or the scroll spring. Normally, however, the folding doors 2 and 3 are only operated manually, and specifically generally with one hand. That is, the folding doors 2 and 3 are both opened and closed manually. In contrast, the door closer 15, 16 is functionally decoupled from the actuating mechanisms 17 and consequently also from the folding doors 2 and 3. In the framework of the illustrated embodiment, it is only used when, due to the elevated temperature the element or the scroll spring 15, with the assistance of the release device 16, can no longer be held in the pre-stressed position and consequently relaxes. If the two folding doors 2 and 3 are in their closed position in this situation, they are automatically locked using the element or the door closer 15, 16.

In this manner the substances and chemicals stored in the associated cabinet are protected from the direct effects of flames and possibly an explosion if there is a fire. Naturally the release device 16 can also ensure in a different manner that the pre-stressed spring 15 accomplishes its effect for the automatic door closing. In this regard it is conceivable to use an electromagnetically actuated release device 16 that receives its signal for instance from a master station.

We claim:

1. A cabinet comprising:

a body having an open side;

two doors each comprised by an outer panel and an inner panel, the panels each being pivotal between a closed position in which all the panels are generally coplanar and cover the open side with the inner panels between the outer panels and an open position giving access to the open side;

a respective actuating mechanism for each door, each mechanism having an actuating element defining first, second, and third pivot points and pivoted on the body at the respective first pivot point and a pusher pivoted on the respective second pivot point and having a pair of arms with outer ends connected to the respective doors; and a rigid connector extending between the third pivot points and extending at all times across a line extending between the first pivot points.

2. The cabinet defined in claim 1 wherein the actuating mechanisms are mirror-symmetrical to a plane between them.

3. The cabinet defined in claim 1 wherein on movement between the open and closed position the pushers pivot on the respective actuating element and also move outward from the cabinet body.

4. The cabinet defined in claim 1 wherein in the closed position the arms of each pusher are generally parallel and in the open position form an acute angle to each other.

5. The cabinet defined in claim 1 wherein in the open and closed position the connector forms generally the same acute angle with the line.

6. The cabinet defined in claim 1, further comprising a door closer operatively connected to the connecting element.

7. The cabinet defined in claim 6 wherein the door closer includes a spring and a heat-operable element holding the spring in a stressed condition below a predetermined temperature.

8. The cabinet defined in claim 1 wherein the door panels are each pivoted about a respective vertical door axis on the cabinet body.

9. The cabinet defined in claim 8 wherein the door axes are spaced parallel to a plane of the open side.

10. The cabinet defined in claim 9 wherein the door axes of the inner panels are spaced inward toward the cabinet body relative to the plane of the door axes of the outer panels.

11. The cabinet defined in claim 10 wherein each inner panel has an outrigger arm projecting to the respective door axis.

12. The cabinet defined in claim 1 wherein the arms have outer ends pivoted on the respective door panels.

13. The cabinet defined in claim 12 wherein the arms of the inner panels have inner ends pivoted at the respective second pivot points.

14. The cabinet defined in claim 1 wherein the pivot points all define generally parallel axes spaced from one another.

* * * * *

UNITED STATES PATENT AND TRADEMARK OFFICE

CERTIFICATE OF CORRECTION

PATENT NO. : 7,946,665 B2
APPLICATION NO. : 12/268551
DATED : May 24, 2011
INVENTOR(S) : Frank Backhaus et al.

It is certified that error appears in the above-identified patent and that said Letters Patent is hereby corrected as shown below:

On the Title Page Item (73) should read:

DUEPERTHAL SICHERHEITSTECHNIK GMBH & CO. KG

Signed and Sealed this
Fourth Day of October, 2011

David J. Kappos

David J. Kappos
*Director of the United States Patent and Trademark Office*